US007205951B2

(12) United States Patent
Matsui

(10) Patent No.: US 7,205,951 B2
(45) Date of Patent: Apr. 17, 2007

(54) MULTIBEAM FEEDHORN, FEED APPARATUS, AND MULTIBEAM ANTENNA

(75) Inventor: Yoshikazu Matsui, Kobe (JP)

(73) Assignee: DX Antenna Company, Limited, Kobe-shi, Hyogo-ken (JP)

( * ) Notice: Subject to any disclaimer, the term of this patent is extended or adjusted under 35 U.S.C. 154(b) by 0 days.

(21) Appl. No.: 11/417,639

(22) Filed: May 4, 2006

(65) Prior Publication Data

US 2006/0262021 A1 Nov. 23, 2006

(30) Foreign Application Priority Data

May 19, 2005 (JP) ..... 2005-146501

(51) Int. Cl.
*H01Q 13/00* (2006.01)

(52) U.S. Cl. ..... 343/786; 343/776; 343/779

(58) Field of Classification Search ..... 343/786, 343/772, 776, 840, 779
See application file for complete search history.

(56) References Cited

U.S. PATENT DOCUMENTS

| | | | | |
|---|---|---|---|---|
| 4,090,203 | A * | 5/1978 | Duncan | 343/753 |
| 4,811,029 | A * | 3/1989 | Nomoto et al. | 343/779 |
| 5,949,387 | A * | 9/1999 | Wu et al. | 343/909 |
| 6,388,633 | B1 * | 5/2002 | Imaizumi et al. | 343/776 |
| 6,864,850 | B2 * | 3/2005 | Imaizumi et al. | 343/776 |

FOREIGN PATENT DOCUMENTS

JP 2002-124820 A 4/2002

* cited by examiner

*Primary Examiner*—Hoanganh Le
(74) *Attorney, Agent, or Firm*—Duane Morris LLP

(57) ABSTRACT

A multibeam primary radiator apparatus (2) includes first, second and third primary horns (16, 18, 20). The first primary horn (16) has a generally circular proximal end aperture (22) at its proximal end, and a generally circular distal end aperture (24) at its distal end, which is larger than the proximal end aperture (22). The second and third primary horns (18, 20) have generally circular proximal end apertures (26, 28) at their proximal ends, and larger distal end apertures (30, 32) at their distal ends. The first through third primary horns are disposed with the center axes of the respective proximal end apertures being substantially in parallel with each other. The distance between the center axis of the first primary horn (16) and each of the second and third primary horns (18, 20) is smaller than the diameter of the proximal end aperture (22) of the first primary horn (16). The distal end aperture (30, 32) of each of the second and third primary horns (18, 20) is formed by a semicircular portion (30*a*, 32*a*), which is half of a circle having a diameter larger than the proximal end aperture (26, 28), on the side remote from the first primary horn (16), and also a semi-elliptical portion (30*b*, 32*b*), which is half of an ellipse, on the side closer to the first primary horn (16). Each semi-elliptical portion (30*b*, 32*b*) is contiguous to the associated semicircular portion (30*a*, 32*a*) at the two ends of the major axis thereof, and is located in a void in the distal end aperture (24) of the first primary horn (16). The end of the minor axis of each ellipse is located outward of the proximal end aperture (22) of the first primary horn (16).

7 Claims, 6 Drawing Sheets

MULTIBEAM FEEDHORN, FEED APPARATUS, AND MULTIBEAM ANTENNA

This invention relates to a multibeam feedhorn, a frequency converter formed integral with a multibeam feedhorn, and a multibeam antenna with such multibeam feedhorn or frequency converter.

BACKGROUND OF THE INVENTION

Recently, plural communications satellites have been launched to locations spaced by a small distance on the same orbit. In order to receive electromagnetic waves from such closely spaced satellites, an antenna with one reflector and plural horns would be used. An example of such antennas is disclosed in JP 2002-124820 A.

According to JP 2002-124820 A, a multibeam primary radiator apparatus is disposed near the focal point of the reflector. The multibeam primary radiator apparatus includes two waveguides disposed in parallel with each other, and the horns are mounted at the distal ends of the respective waveguides. Each of the horns has circular apertures at its distal and proximal ends, respectively.

The antenna disclosed in JP 2002-124820 A can receive electromagnetic waves from two closely spaced communications satellites. In recent years, there are cases in which two communications satellites are launched to locations more close to each other than ever, for example, spaced by an angular distance of 1.9 degrees. It is difficult to closely dispose horns with circular apertures at their distal and proximal ends, in order to receive waves from such further closely spaced communications satellites.

An object of the present invention is to provide a multibeam primary radiator apparatus which can receive electromagnetic waves from closely spaced geostationary satellites. Another object of the invention is to provide a feed apparatus with such multibeam primary radiator apparatus and a multibeam antenna with such feed apparatus or the multibeam primary radiator apparatus.

SUMMARY OF THE INVENTION

A multibeam primary radiator apparatus according to an aspect of the present invention has at least first and second horns. The first horn has a generally circular aperture at its proximal end, and also a generally circular aperture at its distal end, which is larger than the proximal end aperture. The first horn may be generally in the shape of a truncated cone. The second horn has a generally circular aperture at its proximal end, and also an aperture at its distal end, which is larger than the proximal end aperture. The first and second horns have their respective center axes passing through the centers of the proximal end apertures disposed in parallel with each other. The distance between the two center axes is smaller than the diameter of the proximal end aperture of the first horn. In this manner, the first and second horns are disposed close to each other. The distal end aperture of the second horn includes a semicircular portion, which is half of a circle having a larger diameter than the proximal end aperture. The semicircular portion is formed on the side opposite the side on which the first horn is disposed. The second horn also includes a portion having a shape of half of an ellipse (hereinafter referred to as semi-elliptical portion) contiguous to the semicircular portion. The semi-elliptical portion is on the first-horn side of the second horn. The major axis of the semi-elliptical portion is aligned with the diameter of the semicircular portion. The periphery of the first portion around its distal end aperture has a portion removed, where the semi-elliptical portion is located. The minor axis of the semi-elliptical portion has its end located outward of the proximal end aperture of the first horn.

With the above-described structure, more particularly, with the second horn having its distal end aperture formed of a semicircular portion and a semi-elliptical portion, the distal end apertures of the first and second horns can be disposed close to each other. In addition, because the end of the minor axis of the semi-elliptical portion is located outward of the proximal end aperture of the first horn, the proximal end aperture of the first horn can maintain any desired diameter, and a circular waveguide can be coupled to the proximal end aperture of the first horn.

A third horn having the same structure as the second horn may be disposed on the other side of the first horn from the second horn. The second and third horns may be disposed in line symmetry with respect to the center axis of the proximal end aperture of the first horn.

An antenna with this arrangement can receive electromagnetic waves from three closely spaced geostationary satellites.

A fourth horn may be disposed outside one of the second and third horns. Like the second horn, the fourth horn may have a distal end aperture formed of a semicircular portion and a semi-elliptical portion, with the semi-elliptical portion located in a notch formed in the semicircular portion of that one of the second and third horns. In addition to the fourth horn, a fifth horn may be disposed outside the other of the second and third horns. The fifth horn has the same structure as the fourth horn.

With this arrangement, the antenna can receive electromagnetic waves from four or five closely spaced geostationary satellites.

A feed apparatus can be formed by providing a converter formed integral with any one of the above-described multibeam primary radiator apparatus. For example, circular waveguides are coupled to the proximal ends of the first and second horns, and waves transmitted through the waveguides are guided to a converter formed integral with the waveguides where they are frequency-converted to IF signals. The feed apparatus may be disposed in the vicinity of the focal point of a reflector, e.g. a parabolic reflector, an offset parabolic reflector or a cylindrical parabolic reflector, to thereby form a multibeam antenna. Any of the above-described multibeam primary radiator apparatus may be disposed in the vicinity of the focal point of a reflector, e.g. a parabolic reflector, an offset parabolic reflector or a cylindrical parabolic reflector, to thereby form a multibeam antenna. In this arrangement, too, it is preferable to couple a circular waveguide to the proximal end of each of the first and second horns.

DESCRIPTION OF PREFERRED EMBODIMENT OF THE INVENTION

Figure 1:
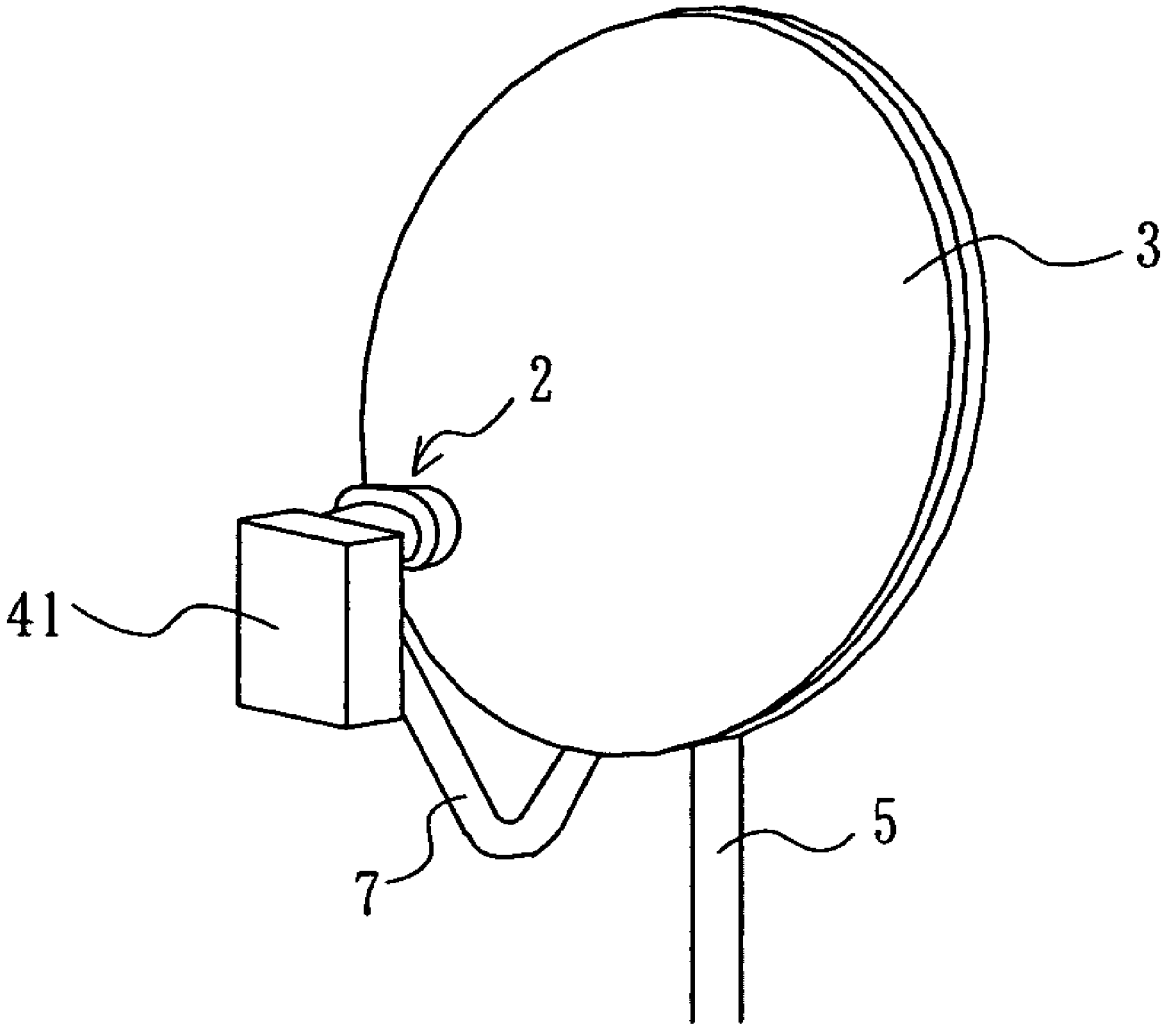
FIG. 1 is a perspective view of a multibeam antenna according to a first embodiment of the present invention.

As shown in FIG. 1, a multibeam primary radiator apparatus 2 according to an embodiment of the present invention is disposed in the vicinity of the focal point of, for example, an offset parabolic reflector 3, and faces the reflector 3, which, in turn, is supported by a post 5. The primary radiator apparatus 2 is mounted to the reflector 3 by an arm 7.

Figure 2A:
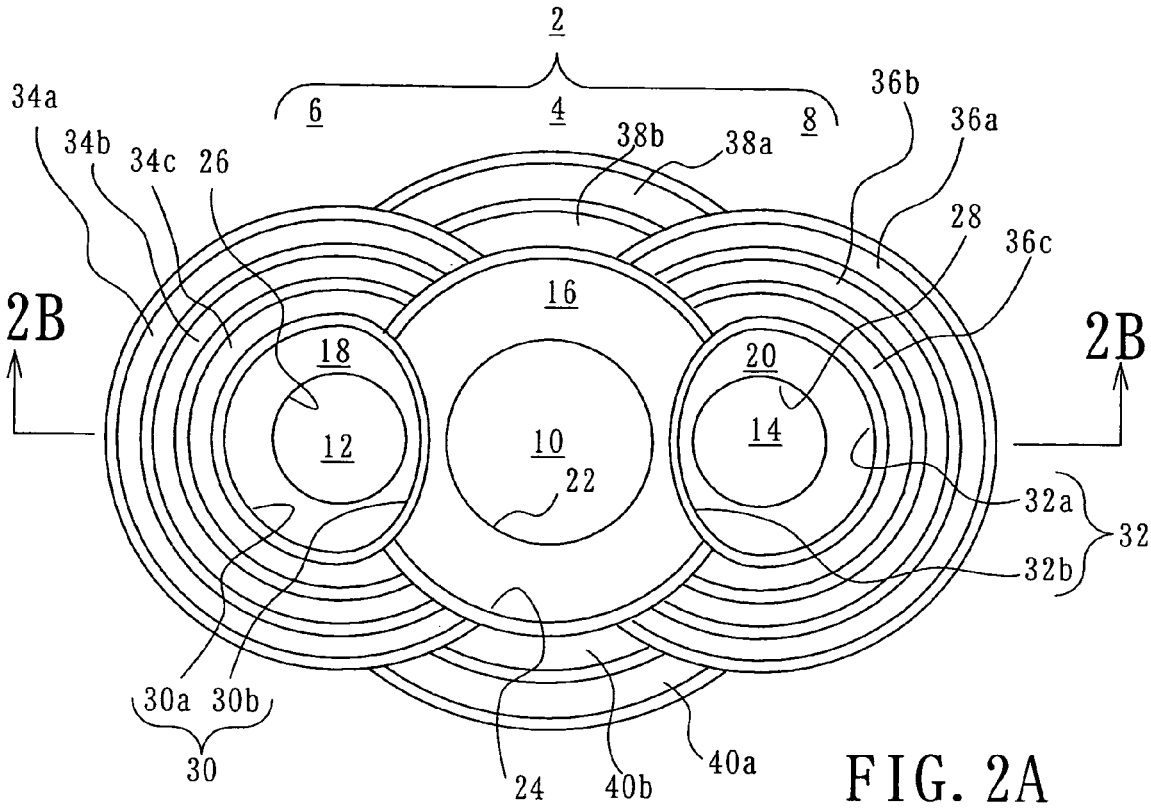
FIG. 2A is a plan view of a multibeam primary radiator apparatus for use in the multibeam antenna shown in FIG. 1.
Figure 2B:
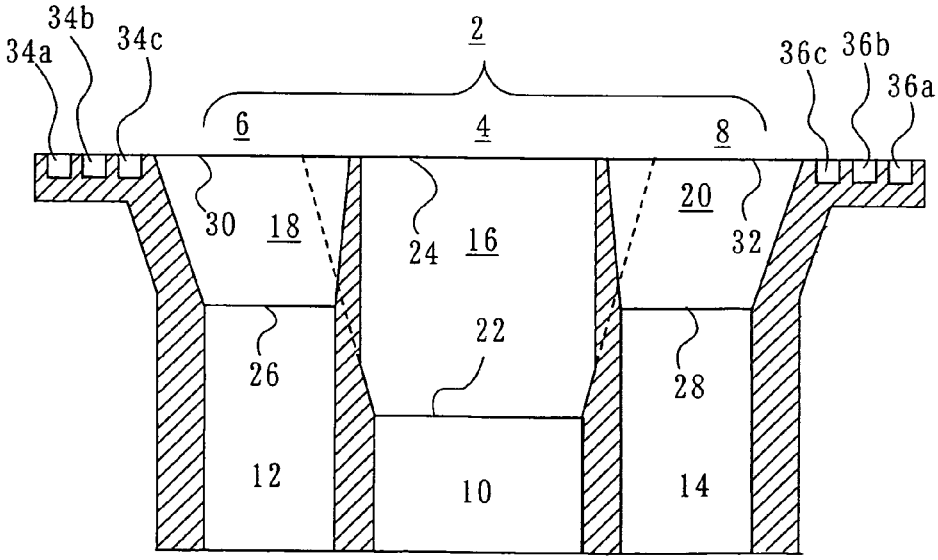
FIG. 2B is a longitudinal cross-sectional view of the multibeam primary radiator apparatus along a line 2B—2B in FIG. 2A.

The multibeam primary radiator apparatus 2 has plural, e.g. three, primary radiators 4, 6 and 8, as shown in FIGS. 2A and 2B. The primary radiators 4, 6 and 8 are adapted to receive electromagnetic waves from three geostationary satellites, such as communications satellites, which are angularly spaced by a very small angular distance of, e.g. 1.9 degrees, on a geostationary orbit. Such communications satellites include a communications satellite for the Ku band (from 11.7 GHz to 12.2 GHz), and communications satellites for the Ka band (from 18.3 GHz to 20.2 GHz) launched to locations on the respective sides of the Ku band satellite with an angular spacing of 1.9 degrees respectively from the center Ku band satellite. The center primary radiator 4 is for receiving the Ku band, and the primary radiators 6 and 8 on the opposite sides of the primary radiator 4 are for receiving waves in the Ka band.

The primary radiator 4 includes a circular waveguide 10, and the primary radiators 6 and 8 have also circular waveguides 12 and 14, respectively. The diameters of the waveguides 10, 12 and 14 are so determined, in view of transmission frequencies, that the circular waveguide 10 has a larger diameter than the circular waveguides 12 and 14 having the same diameter. For example, the diameter of the waveguide 10 is 17.48 mm, and the diameter of the waveguides 12 and 14 is 11.13 mm. The center axes of the waveguides 10, 12 and 14 extend in parallel with each other, and are closely spaced on the same line. The distance between the center axes of the side circular waveguides 12 and 14 may be, for example, 35 mm. The distance between the center axis of the center circular waveguide 10 and each of the side waveguides 12 and 14 is, for, example, 17.5 mm, which is smaller than the radius of a distal end aperture 24 of a primary horn 16 described later.

The first primary horn 16 is coupled to the distal end of the circular waveguide 10, and second and third primary horns 18 and 20 are coupled to the distal ends of the circular waveguides 12 and 14, respectively.

The first primary horn 16 has a proximal end aperture 22 having the same diameter as the distal end aperture of the circular waveguide 10, and also has the aforementioned distal end aperture 24 at its distal end.

The second and third primary horns 18 and 20 have proximal end apertures 26 and 28, respectively, of which diameters are equal to the diameter of the distal end apertures of the circular waveguides 12 and 14. The second and third primary horns 18 and 20 also have distal end apertures 30 and 32 at the respective distal ends.

The proximal end circular aperture 22 of the first primary horn 16 is located inward of the proximal end apertures 26 and 28 of the second and third primary horns 18 and 20, and the respective distal end apertures 24, 30 and 32 are lying in the same plane.

The distal end aperture 24 of the first primary horn 16 is originally a circular aperture having a larger diameter than the proximal end aperture 22, which may be, for example, 31 mm (which is 1.3 times as large as the wavelength of the wave to be received). However, the original aperture overlaps the distal end apertures 30 and 32 of the second and third primary horns 18 and 20, and, therefore, the overlapping portions are removed. The shape of the first primary horn 16 with the distal end aperture 24 of the original shape is represented by broken lines in FIG. 2B.

The distal end apertures 30 and 32 of the second and third primary horns 18 and 20 have semicircular portions 30*a* and 32*a*, respectively, on the sides thereof remote from the distal end aperture 24 of the first primary horn 16. The diameters of the semicircular portions 30*a* and 32*a* are equal to or smaller than the diameter of the distal end aperture 24 of the first primary horn 16, which may be, for example, 1.3 times of the wavelength of the waves to be received, which may be 9.65 mm. The distal end apertures 30 and 32 also have portions 30*b* and 32*b*, each having a shape of a half of an ellipse (hereinafter referred to as semi-elliptical portions), which are formed to be contiguous to the semicircular portions 30*a* and 32*a*. The semi-elliptical portions 30*b* and 32*b* have their edges on the major axes thereof connected to the edges of the semicircular portions 30*a* and 32*a*. In other words, the length of the major axes of the semi-elliptical portions 30*b* and 32*b* is equal to the diameter of the semicircular portions 30*a* and 32*a*. The ends of the minor axes of the respective semi-elliptical portions 30*b* and 32*b* remote from the circular portions 30*a* and 32*a*, respectively, are located outward of the proximal end aperture 22 of the first primary horn 16, and the length of the minor axes may be 7 mm, for example. In other words, the semi-elliptical portions 30*b* and 32*b* interfere with neither of the proximal end circular aperture 22 and the circular waveguide 10.

A corrugation including three, for example, concentric grooves 34*a*, 34*b* and 34*c* and a corrugation including three, for example, concentric grooves 36*a*, 36*b* and 36*c* are formed to surround the outer peripheries of the second and third primary horns 18 and 20, respectively. A corrugation including two, for example, concentric grooves 38*a* and 38*b* and 40*a* and 40*b*, is formed to surround the outer periphery of the first primary horn 16.

The primary horns 16, 18 and 20 are integrally formed together with the corrugations including the grooves 34*a*–34*c*, 36*a*–36*c*, 38*a*–38*b* and 40*a*–40*b*.

As shown in FIG. 1, a frequency converter 41 is formed integral with the multibeam primary radiator apparatus 2, and forms a feed apparatus together with the primary radiator apparatus 2. Received Ku band and Ka band electromagnetic waves propagating through the circular waveguides 10, 12 and 14 are supplied through probes (not shown) within the circular waveguides 10, 12 and 14 to the frequency converter 41. The waves are converted to IF signals at given frequencies in the frequency converter 41. The feed apparatus and the offset parabolic reflector form a multibeam antenna.

Figure 3A:
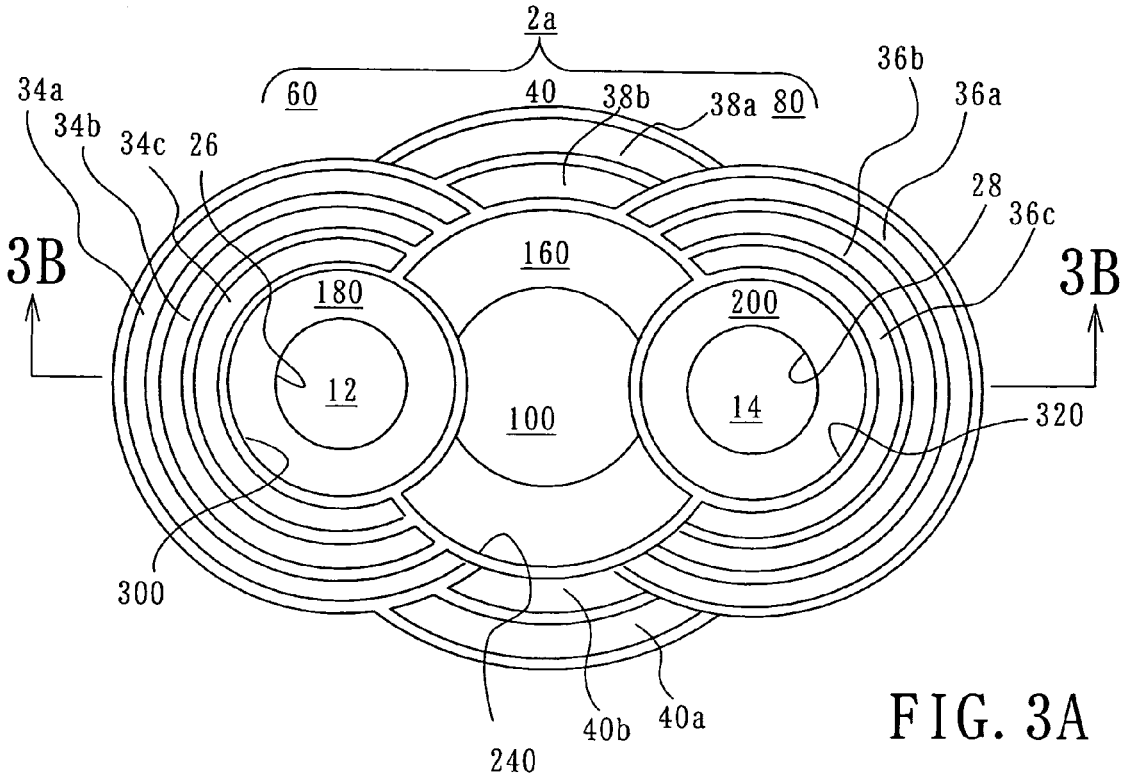
FIG. 3A is a plan view of a modification of the multibeam primary radiator apparatus shown in FIGS. 2A and 2B.
Figure 3B:
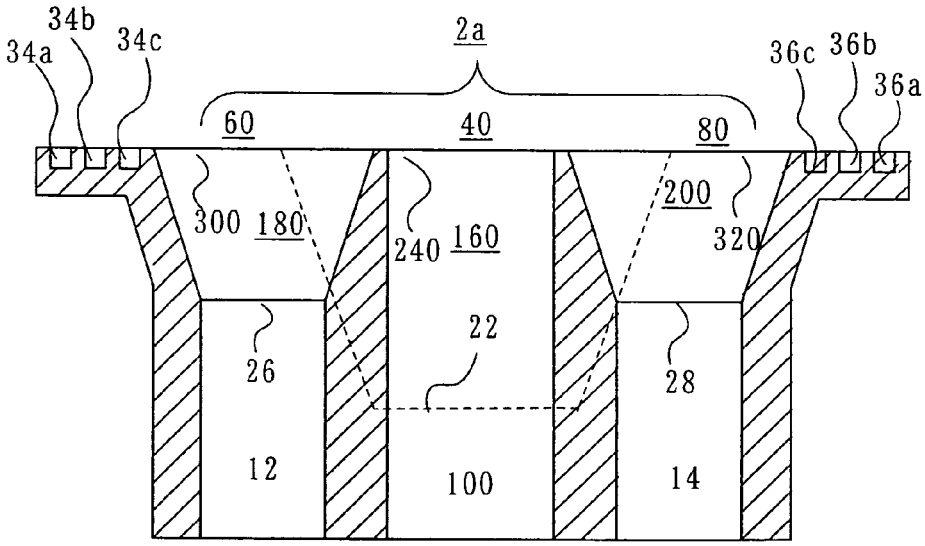
FIG. 3B is a longitudinal cross-sectional view of the multibeam primary radiator apparatus along a line 3B—3B in FIG. 3A.

FIGS. 3A and 3B show a modified multibeam primary radiator apparatus 2*a*, for reference. The modified multibeam primary radiator apparatus 2*a* is the same as the above-described multibeam primary radiator apparatus 2 except that the distal end apertures of the second and third horns 18 and 20 of the primary radiators 6 and 8 are replaced by circular apertures 300 and 320, respectively. The diameter of the distal end circular apertures 300 and 320 of the second and third primary radiators 60 and 80 is equal to the diameter of the semicircular portions 30*a* and 32*a* of the distal end apertures 30 and 32 of the second and third primary horns 18 and 20 of the multibeam primary radiator apparatus 2. When such circular apertures 300 and 320 are employed, a distal end aperture 240 of a first primary horn 160 of a first primary radiator 40 of the multibeam primary radiator apparatus 2*a* should be larger, which would result in distortion of a waveguide 100 to be coupled to the first primary horn 160 from a circular shape. The remainder of the structure of the multibeam primary radiator apparatus 2*a* is same as the multibeam primary radiator apparatus 2, and, therefore, the same reference numerals as used for the primary radiator apparatus 2 are used for the same or similar components, and their description in detail are not given any more. The diameter of the distal end apertures 300 and 320 is 1.3 times, for example, as large as the wavelength to be received. The diameter of the distal end aperture 240 of the first primary horn 160 in its normal or original shape is 1.3 times, for example, as large as the wavelength to be received. In this structure, the distal end circular apertures 300 and 320 of the second and third primary horns 180 and 200 overlap the distal end aperture 240 of the first primary horn 160 to a great extent, and interfere with the waveguide 100 to distort the shape of the waveguide 100 as described above. The broken lines in FIG. 3B indicate the shapes of the first primary horn 160 and the waveguide 100 when the distal end aperture 240 is in its original shape.

Figure 4:
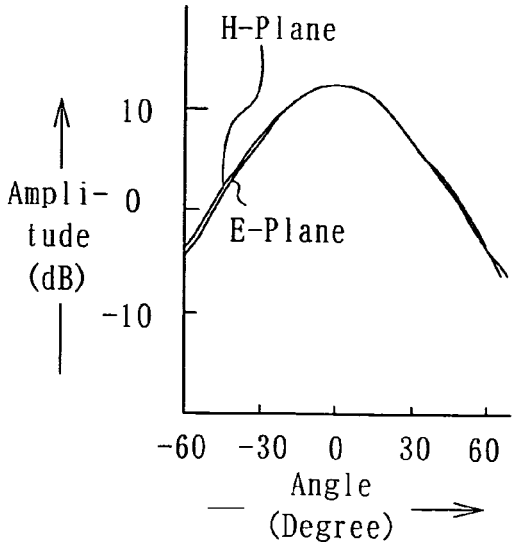
FIG. 4 is a directivity pattern of a primary radiator of the multibeam primary radiator apparatus of FIGS. 3A and 3B.

FIG. 4 shows a result of simulation of the directivity of the second and third primary horns 180 and 200 of the modified multibeam primary radiator apparatus 2*a* shown in FIGS. 3A and 3B. The primary radiator apparatus 2*a* exhibits substantially the same directivities in the E and H planes, and, in a circular polarization application, it is expected to exhibit no circular polarization degradation due to the directivities of the second and third primary horns 180 and 200. As for the first primary radiator 40, the shapes of the first primary horn 160 and the waveguide 100 are complicated, and both the impedance matching and directivity of the first primary radiator 40 are expected to be greatly degraded.

Figure 5A:
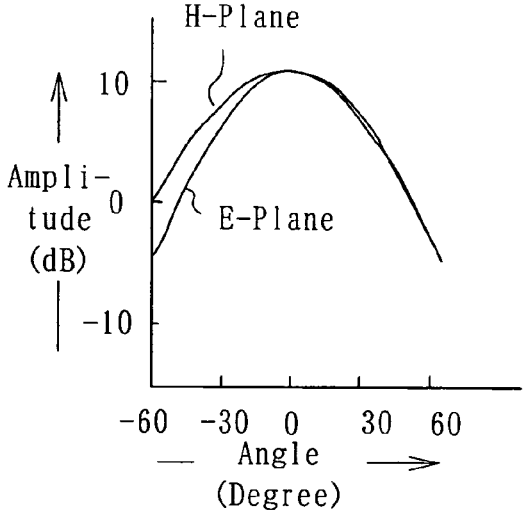
FIG. 5A is a directivity pattern for vertical polarization of second and third primary horns of primary radiators of the multibeam primary radiator apparatus of FIGS. 2A and 2B.
Figure 5B:
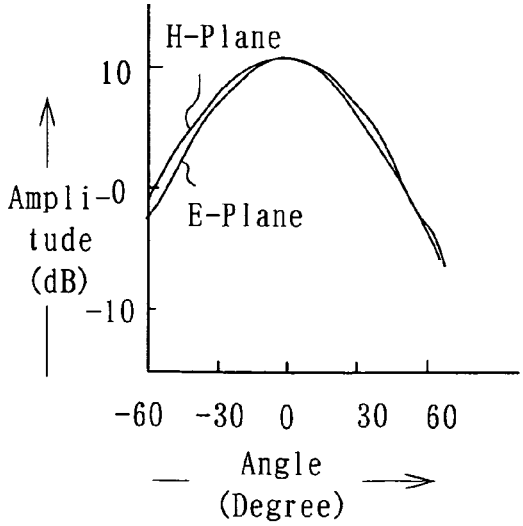
FIG. 5B is a directivity pattern for horizontal polarization of the second and third primary horns of the primary radiators of the multibeam primary radiator apparatus of FIGS. 2A and 2B.

FIGS. 5A and 5B are directivity patterns for the vertical and horizontal polarizations, respectively, of the second and third primary horns 18 and 20 of the multibeam primary radiator apparatus 2 shown in FIGS. 2A and 2B. As is seen from the horizontal polarization directivity shown in FIG. 5B, there is almost no difference in directivity between the E and H planes, but, with respect to the vertical polarization, as shown in FIG. 5A, there is a difference of about 2 dB at the direction of −30 degrees. It is thought that, when combined with a reflector, the horns may give some adverse effect to the circular polarization characteristic, but significant degradation is not expected. When a reflector having an F/D ratio of 0.65 is used, the angle between the lines connecting the second and third primary horns and the periphery of the reflector is approximately ±32.5 degrees. This angular range is to be considered with respect to the matching of the second and third primary horns 18 and 20 with the reflector.

Figure 6A:
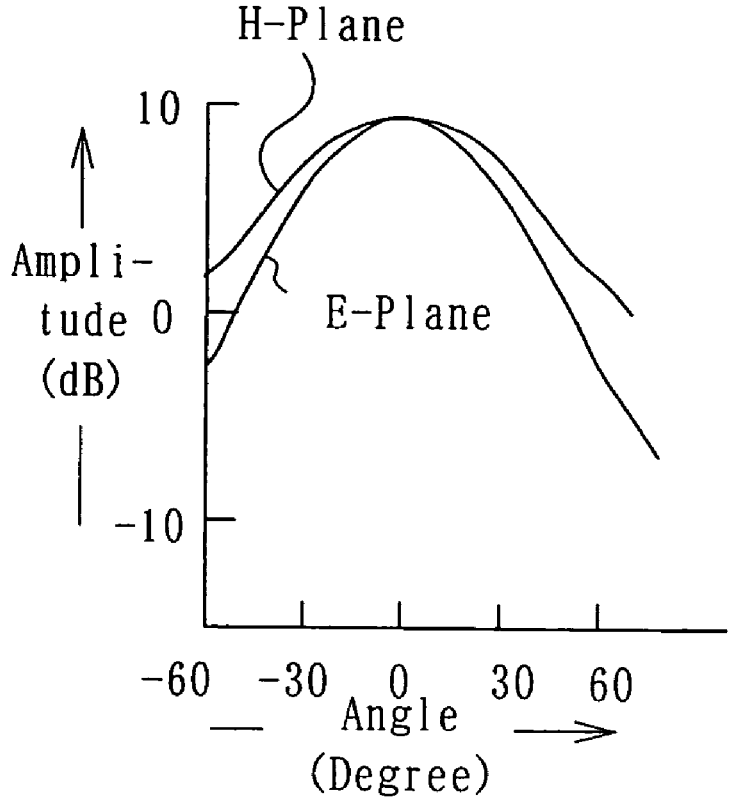
FIG. 6A is a result of simulation of horizontal polarization of a primary horn of a primary radiator of the multibeam primary radiator apparatus of FIGS. 2A and 2B, obtained by approximating it with an ellipse.
Figure 6B:
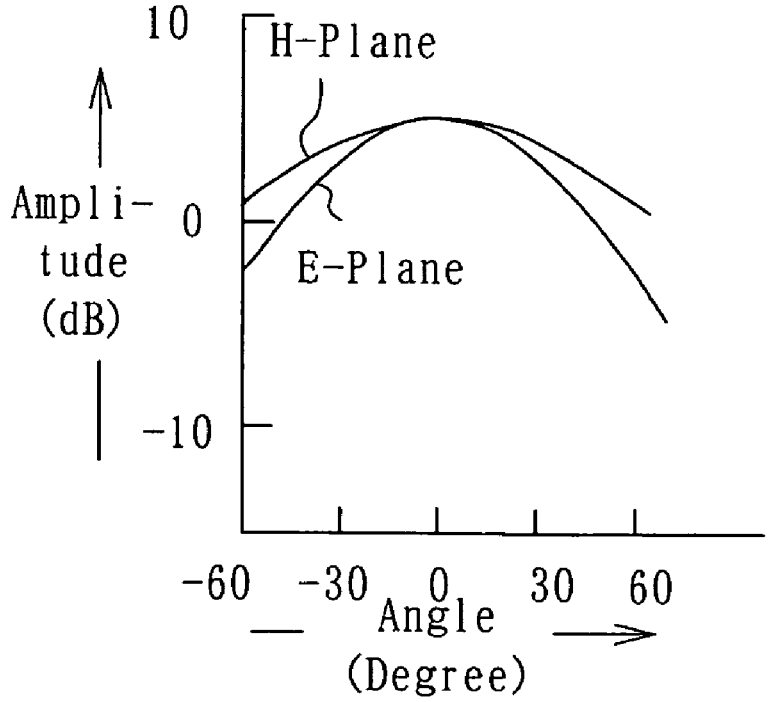
FIG. 6B is a result of simulation of vertical polarization of the first primary horn of the primary radiator of the multibeam primary radiator apparatus of FIGS. 2A and 2B, obtained by approximating it with an ellipse.

FIGS. 6A and 6B are results of simulation of the first primary horn 16 with an ellipse. FIG. 6A shows the horizontal polarization characteristic, and FIG. 6B shows the vertical polarization characteristic. For both of the horizontal and vertical polarizations, a difference in directivity of about 1 dB is seen between the E and H planes at the directions of +30 degrees and −30 degrees. As a result, it is considered that, when the first primary horn 16 is used in combination with a reflector, degradation of the circular polarization characteristic is larger than with the primary radiators 6 and 8, but characteristic degradation due to difference in directivity of the primary horn 16, when used in combination of a reflector, is considered not to pose any practical problem because the axial ratio performance value is 1 dB and the angular range is limited.

Thus, by the use of the multibeam primary radiator apparatus 2 shown in FIGS. 2A and 2B, a three-beam primary radiator apparatus with little performance degradation can be realized for Ka-band, Ku-band and Ka-band satellites at orbital locations spaced by an angle of 1.9 degrees from adjacent ones.

The multibeam primary radiator apparatus according the above-described embodiment includes the second and third primary horns 18 and 20, but only one of them may be used.

Figure 7:
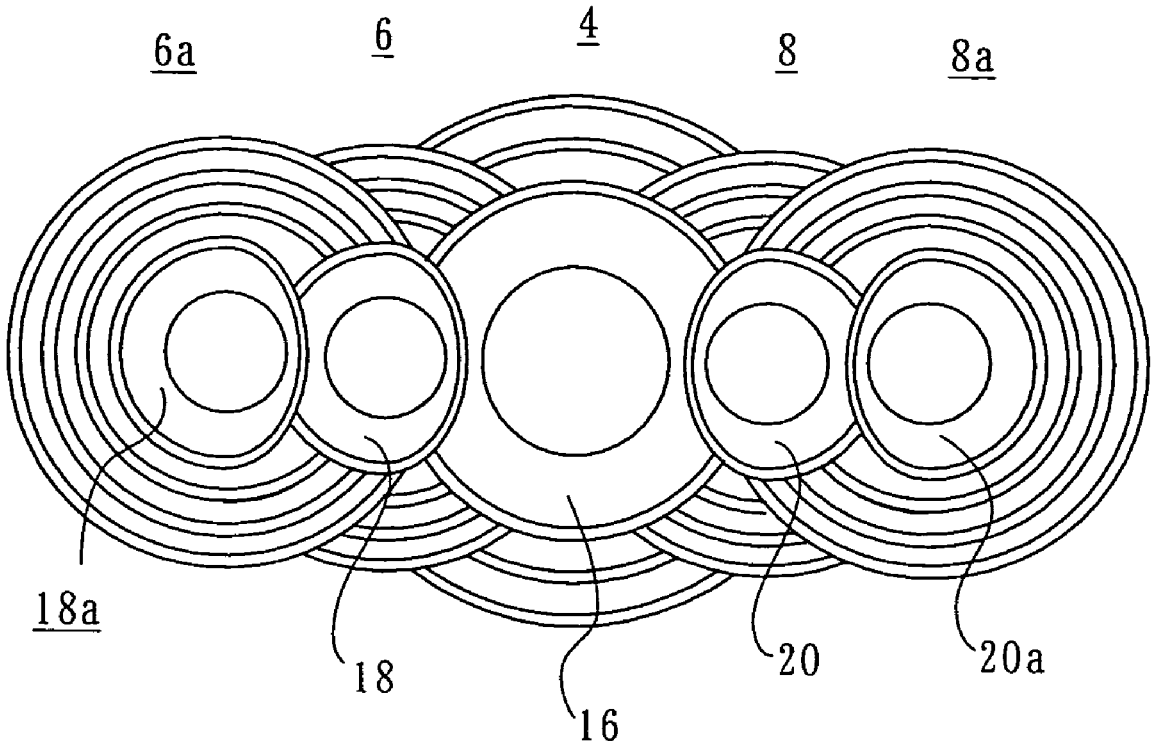
FIG. 7 is a plan view of a multibeam primary radiator apparatus for use in a multibeam antenna according to another embodiment of the invention.

In addition to the first, second and third primary radiators 4, 6 and 8, fourth and fifth radiators 6*a* and 8*a* may be disposed outward of the second and third radiators 6 and 8, respectively, as shown in FIG. 7. In this case, it is desirable that the primary radiators 4, 6, 8, 6*a* and 8*a* be formed integral with each other. The distal end aperture of each of the primary horns 18*a* and 20*a* of the fourth and fifth primary radiators 6*a* and 8*a* is formed of a semicircular portion disposed on the side remote from the corresponding one of the second and third horns 18 and 20, and a semi-elliptical portion on the inner side closer to the corresponding one of the second and third horns 18 and 20.

In the above-described embodiments, the frequency converter 41 has been described to be formed integral with the primary radiator apparatus 2, but it may be formed as a component separate from the primary radiator apparatus 2.

What is claimed is:

1. A multibeam primary radiator apparatus comprising first and second horns;

said first horn having a generally circular proximal end aperture at a proximal end thereof, and a generally circular distal end aperture at a distal end thereof, said distal end aperture being larger than said proximal end aperture;

said second horn having a generally circular proximal end aperture at a proximal end thereof, and a distal end aperture larger than said proximal end aperture at a distal end thereof;

said first and second horns being disposed with center axes of said proximal end apertures thereof being in parallel with each other and spaced from each other by a distance smaller than a diameter of said proximal end aperture of said first horn;

said distal end aperture of said second horn including a semicircular portion having a shape which is a half of a circle having a diameter larger than a diameter of the proximal end aperture of said second horn, said semicircular portion being located remote from said first horn, said distal end aperture of said second horn further including a semi-elliptical portion having a shape which is a half of an ellipse, said semi-elliptical portion being contiguous to said semicircular portion at ends thereof on a major axis of said ellipse, said semi-elliptical portion being located to occupy a void in said proximal end aperture of said first horn, an end of a minor axis of said ellipse remote from said semicircular portion being at a location outward of said proximal end aperture of said first horn.

2. The multibeam primary radiator apparatus according to claim 1, further comprising a third horn having the same configuration as said second horn is disposed on the side of said first horn remote from said second horn.

3. The multibeam primary radiator apparatus according to claim 2, further comprising a fourth horn disposed at a location outward of one of said second and third horns.

4. The multibeam primary radiator apparatus according to claim 3, further comprising a fifth horn disposed at a location outward of the other of said second and third horns.

5. A feed apparatus comprising a converter formed integral with the multibeam primary radiator apparatus defined by claim 1.

6. A multibeam antenna comprising said feed apparatus according to claim 5, and a reflector, said feed apparatus being disposed in the vicinity of a focal point of said reflector.

7. A multibeam antenna comprising said multibeam primary radiator apparatus according to claim 1, and a reflector, said multibeam primary radiator apparatus being disposed in the vicinity of a focal point of said reflector.

* * * * *